United States Patent [19]

Gacesa

[11] 4,175,018

[45] Nov. 20, 1979

[54] METHOD OF ELECTROCOATING

[75] Inventor: Gerald R. Gacesa, Baden, Pa.

[73] Assignee: PPG Industries, Inc., Pittsburgh, Pa.

[21] Appl. No.: 795,452

[22] Filed: May 9, 1977

Related U.S. Application Data

[63] Continuation-in-part of Ser. No. 760,781, Jan. 19, 1977, abandoned.

[51] Int. Cl.[2] ..... C25D 13/16

[52] U.S. Cl. ..... 204/181 T; 204/181 C; 204/181 E

[58] Field of Search ..... 204/181 T

[56] References Cited

U.S. PATENT DOCUMENTS

| | | | |
|---|---|---|---|
| 3,340,172 | 9/1967 | Huggard | 204/181 T |
| 3,663,383 | 5/1972 | Matsuda et al. | 204/181 T |

*Primary Examiner*—Howard S. Williams
*Attorney, Agent, or Firm*—William J. Uhl

[57] ABSTRACT

A method for coating an electroconductive article such as a continuous length of flat metal sheet is disclosed. The method of the invention involves passing the electroconductive article into an aqueous electrodeposition bath which contains as the electrocoating vehicle a water-soluble resinous coating material in combination with a water-insoluble emulsified resinous material. The vehicle is electrodeposited on said metal sheet to form a primer coating as the electroconductive article passes through the electrodeposition bath. A top coat is applied to said primer without having previously baked the primer, and the topcoated metal is then passed to a baking station where the top coat and primer coat are baked simultaneously.

The combination of solubilized and emulsified resinous materials offers a number of processing advantages. For example, the electrodeposition bath can be operated at higher temperatures than are normally associated with electrodeposition and since only one baking station is needed, equipment and fuel costs are minimized.

9 Claims, 2 Drawing Figures

METHOD OF ELECTROCOATING

CROSS-REFERENCE TO RELATED APPLICATIONS

This application is a continuation-in-part of copending application Ser. No. 760,781, filed Jan. 19, 1977, now abandoned.

BACKGROUND OF THE INVENTION

1. Field of the Invention

The present invention relates to electrodeposition of aqueous-based coating compositions onto electroconductive substrates. More particularly, the invention relates to a method of continuously electrocoating a length of flat metal sheet such as a continuous length of metal coil.

2. Brief Description of the Prior Art

Coal coating involves the coating of a continuous length of flat metal sheet. The sheet which is usually thin gauge steel or aluminum is usually coiled over a spool which is continuously unwound and passed to a coating station where the sheet is coated in a continuous manner as it passes through the station. At the coating station, which is usually a roll coater or spray coater, a primer coat or a top coat is applied and the coated substrate is then passed to a baking oven for curing. If a primer coat is applied, a top coat is applied after baking of the primer at a second coating station. The top coat must then also be subsequently baked and cured.

There are a number of disadvantages associated with this coating system. In applying only a top coat with no primer coat, the metal substrate does not have outstanding corrosion resistance due to relatively poor adhesion to the substrate and pinholes in the coating. These problems can be overcome by applying a primer coating. However, conventionally applied primers must be baked before application of the top coat. If not baked, the primer will be wet and tacky and will stick to the conveyor rolls transferring the coated coil strip to the topcoater. Also, if the primer coat is wet, it may cause the top coat to blister in the subsequent baking operation. Although the primer coat can be baked before topcoating, this requires an additional baking oven with attending high equipment costs and energy consumption.

It is therefore an object of the present invention to provide a coil coating process which overcomes the above-mentioned difficulties. It is an object of the present invention to provide a coal coating process in which a primer and top coat can be applied sequentially and continuously to a length of metal coil and the two coatings baked and cured simultaneously to produce the final coated article.

SUMMARY OF THE INVENTION

In the present invention, a method for coating an electroconductive article such as a continuous length of flat metal sheet is provided. The electroconductive article is passed into an aqueous electrodeposition bath which contains as an electrocoating vehicle:

(1) a water-soluble resinous coating material, (2) a water-insoluble emulsified resinous material.

As the electroconductive article passes through the bath, the vehicle is electrodeposited on the article to form a primer coating. The primer coated article is removed from the bath and passed to a coating station where a top coat is applied to the primer coated article without having previously cured the primer. The top and primer coating are then cured simultaneously. Usually curing is by baking.

PERTINENT PRIOR ART

Japanese Patent Publication No. 4604/1973 published on Feb. 9, 1973, discloses a method of electrocoating wire from an aqueous electrocoating composition containing a so-called water-soluble resin and a water-dispersible resin. Although the description of these resins in the Patent Publication is sketchy, it is possible that the resinous vehicles are similar to the water-soluble and water-insoluble polymers used in the practice of the invention.

Even assuming this to be true, however, the reference offers no teaching on how to use this particular polymeric system in the method of the present invention. In the Japanese patent, the resinous vehicle is electrodeposited onto the wire and the wire subsequently baked to form a singularly coated article. The present invention, on the other hand, requires a dual coating system which involves the first electrodeposition of a primer coating followed by topcoating over the primer coating without first baking of the primer coating. The dual coated article is then monobaked.

British Pat. No. 1,235,176 relates to applying a primer coat to metal coil by electrodeposition. Also disclosed in the reference is a subsequent topcoating of the primer without having previously baked the primer coating, folllowed by monobaking the two coatings together. However, the reference fails to disclose the mixed resinous vehicle of the present invention and only discloses the use of low molecular weight water-soluble resins for electrodeposition.

Using the mixture of water-insoluble plus water-soluble polymers of the present invention results in significantly lower current draws than in the British patent and in the attaining of higher film builds in short periods of time than that accomplished by using only the water-soluble polymeric materials. In addition, using the mixed polymeric resinous vehicle of the present invention allows operation at higher bath temperatures than that possible using only the lower molecular weight solubilized polymer.

DETAILED DESCRIPTION

Figure 1:
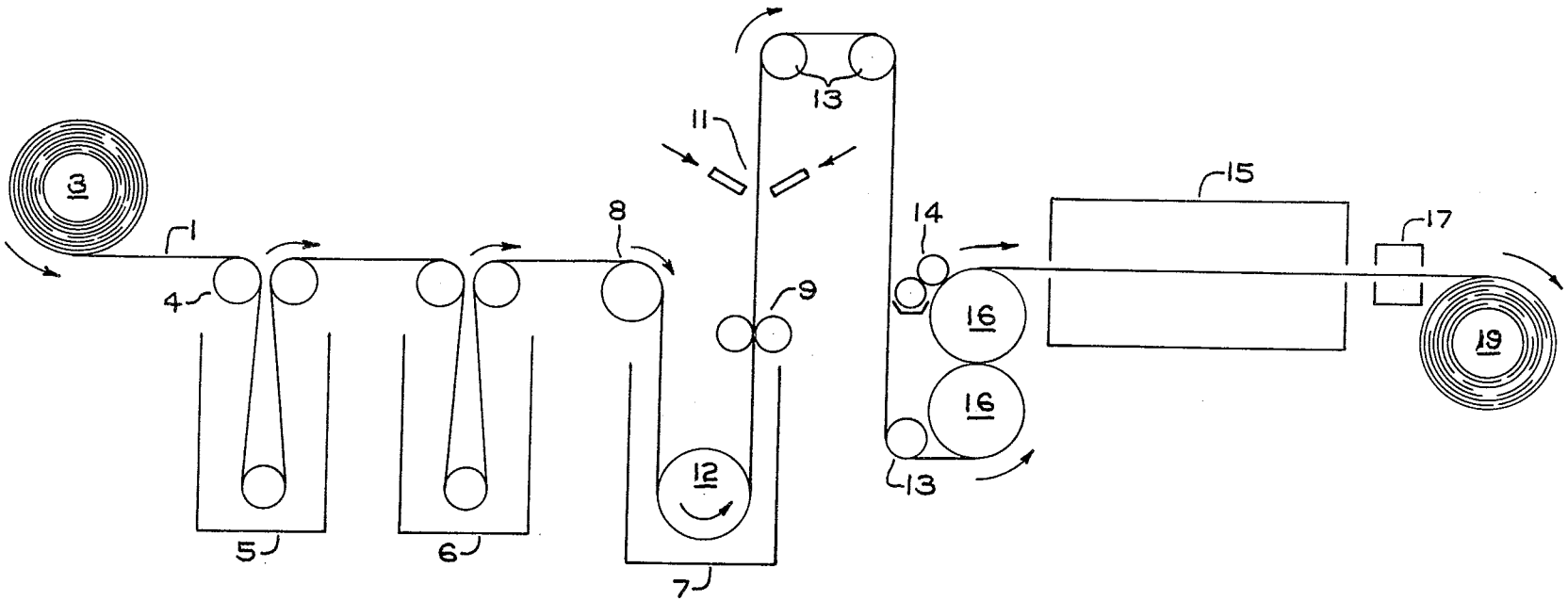
FIG. 1 is a schematic drawing showing the continuous electrocoating method of the invention.

The method of the invention can be seen in connection with the attached drawings. Regarding FIG. 1, a continuous length of coiled metal sheet stock 1 is unwound from the spool 3 and optionally subjected to a cleaning and surface pretreatment. For example, the coil can be conveyed over a guide roll 4 to a tank 5 for degreasing with an alkali wash or the like. The sheet 1 can then be passed to a pretreatment tank 6 for corrosion pretreatment such as by iron phosphating, zinc phosphating or a chromate pretreatment. After the optional pretreatments, the sheet is then passed to an electrodeposition tank 7 shown in more detail in FIG. 2, which contains the mixed electrocoating vehicle of the invention. The sheet than passes through the electrodeposition bath where it is electrocoated with the resinous vehicle to form a primer coat. The coated sheet is removed from the bath and passed between squeegee rolls 9 which return excess coating vehicle (dragout) to the electrodeposition tank 7. Optionally, the coated sheet is passed under an air knife 11 which removes any residual water and coating composition not removed by the squeegee rolls 9. The sheet to which the primer coat has been applied is then topcoated in a conventional manner, for instance, it is led by guide rolls 13 to a roll coater 14 where the top coat is applied. The topcoated sheet is then passed to a drying oven 15 wherein both primer and top coats are baked simultaneously. The baked sheet is then cooled at either ambient conditions or optionally by passing the sheet through a chiller 17, and is then accumulated on a spool 19.

The electroconductive article which is coated in the process of the invention can be any electroconductive metal such as aluminum or steel, including galvanized steel, tin plated and zinc plated steel. The metal substrate is usually cleaned such as by an alkali wash and can optionally be pretreated before electrodeposition with any of the well-known pretreatment techniques such as iron phosphate, zinc phosphate or chromate pretreatments. The coil metal comes in a continuous length which is usually coiled on a spool. Generally the gauge or thickness of the metal sheet is thin, being about 17 to 35 mils. The width of the sheet can vary depending on the application desired. Widths from as low as 9 to as high as 66 inches are not unusual.

Although the drawings show as an embodiment of the invention the continuous electrodeposition of coil metal, it should be realized that the invention is also applicable to the electrodeposition of any electroconductive article such as automobile parts and bodies and appliance parts.

Figure 2:
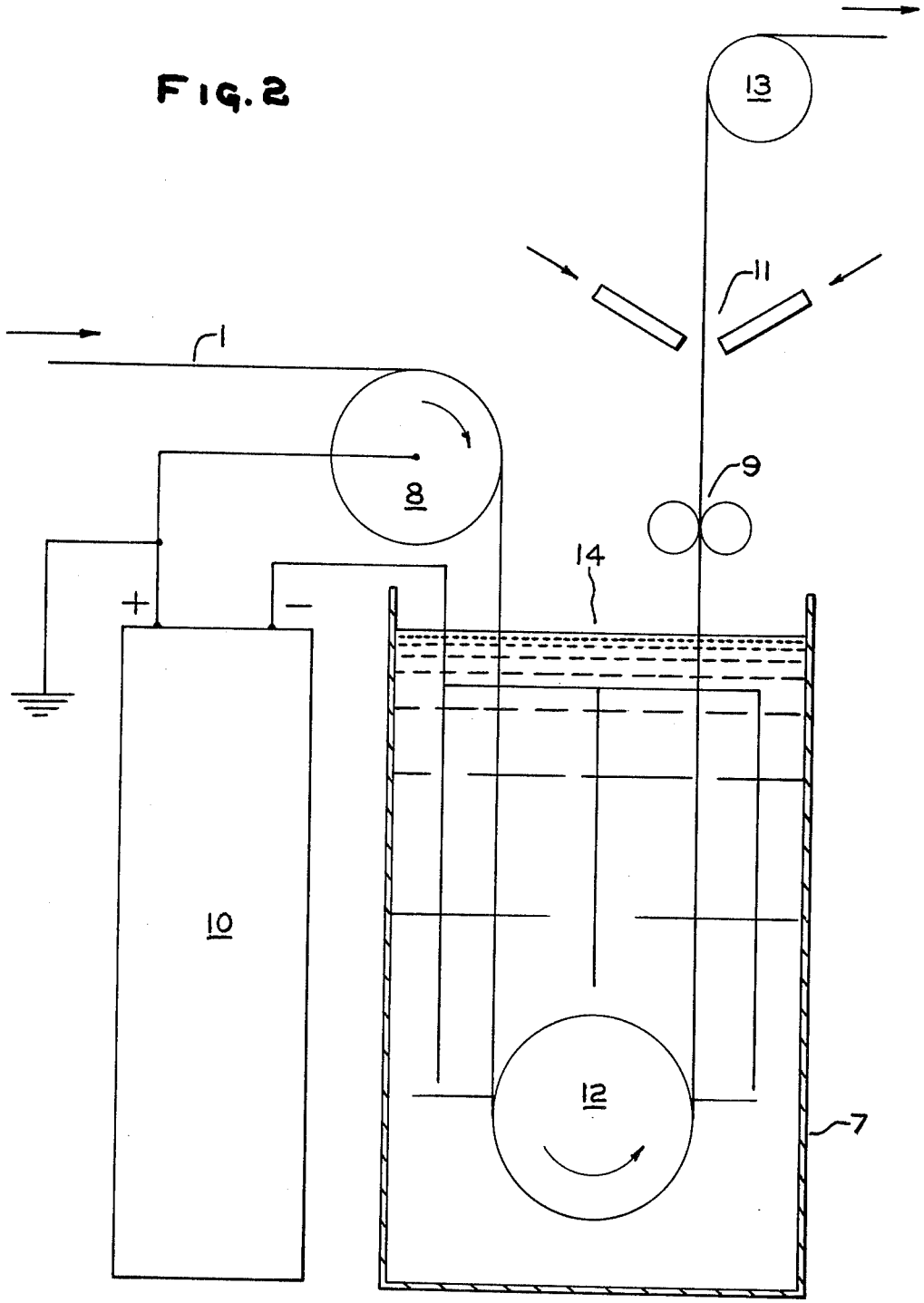
FIG. 2 is an elevated cross-sectional view of an electrodeposition tank for practicing the method of the invention.

Referring once again to the drawings, the electrodeposition bath into which the metal sheet is passed can be seen in some detail in FIG. 2. The sheet 1 passes over a guide roll 8 which is charged with either a positive or negative charge through rectifier 10. The electrodeposition tank 7 is grounded and contains electrodes charged in an opposite manner to that of the sheet such that when the sheet passes through the tank, an electrical potential will be established driving the resinous coating vehicle to the sheet 1 where it electrodeposits. Usually for deposition of uniform coatings, the metal sheet passes into and out of the electrodeposition tank in a substantially vertical manner through a change in direction roll 12. Coating can be on one or both sides of the sheet depending on the electrode arrangement in the tank. FIG. 2 shows an electrode arrangement 14 designed to electrocoat on both sides of the sheets.

Variables such as distance of the metal sheet from the electrodes, residence time of the sheet in the bath and thickness of the applied coating are dependent not only on one another but also on the geometry of the electrodeposition tank and on the characteristics of the bath such as the electrocoating voltage, current draw, conductivity of the electrodeposition bath and resin solids content. In general, for efficient electrocoating, the sheet should pass no more than about 12 inches from the electrode and the sheet usually passes from about 2 to 4 inches from the electrode. Although the speed of the sheet passing through the electrodeposition bath is important for production considerations, the residence time of the sheet in the bath is perhaps a more important variable for electrocoating considerations. In general, line speeds of about 100 to 400 feet per minute are attainable with sheet widths of about 9 to 66 inches. Residence or electrodeposition times in the bath of from about 2 to 10 seconds at bath conductivities, voltages and current draws described below are typical.

In general, the resinous vehicle should be formulated so as to give an operating bath conductivity within the range of 200 to 3000 micromhos, preferably within the range of 1100 to 1800 micromhos. At these bath conductivities and at normal sheet line speeds and residence times in the electrodeposition bath, electrocoating is usually accomplished at 50 to 200 volts with an electrical current draw of 2 to 10 amps per square foot of (substrate) surface area per mil (coating) thickness.

The thickness of the coating is proportional to the relative amounts of solubilized and insolubilized polymer in the resinous vehicle as well as the voltage and current draw. In general, bath variables should be adjusted so as to produce a coating thickness on the order of about 0.01 to 1.0, preferably 0.1 to 0.5 mil, which has been found to be the most desirable thickness for a primer coating for coil metal.

The mixture of soluble and insoluble polymers permits one to electrocoat at relatively high temperatures. Being able to operate at high temperatures is desirable because in electrodeposition, the current flow generates quite a bit of heat which must be removed from the bath by external sources such as chillers or the like. Conventional electrodeposition baths for automotive and appliance coatings generally operate at 65° to 90° F. (18° to 32° C.). In the process of the invention which uses a combination of low molecular weight soluble polymer and high molecular weight insoluble polymers, relatively high operating temperatures can be used, that is, 95° to 120° F. (35° to 49° C.) because the coating thickness does not increase with temperature. In fact, it slightly decreases.

As the electrocoated sheet is removed from the bath, it passes between squeeze rolls 9 to remove excess coating composition (dragout) from the bath. As is shown in the figures, the squeegee rolls are arranged so as to return the dragout back to the electrodeposition bath. After the coated sheet passes through the squeegee rolls, it may optionally pass beneath an air knife 11 to remove any remaining surface moisture. The combination of squeegee rolls and air knife should be sufficient to make the coating dry and non-tacky to the touch. Moisture content has an effect on coating tackiness and will be determined in part by how effective the squeegee rolls and air knife are in removing dragout and surface moisture from the coated metal surface, In general, the moisture content of the coating should be that sufficient to result in a non-tacky coating. The moisture content necessary to obtain a non-tacky coating can vary somewhat depending on the glass transition temperatures of the soluble and insoluble polymers, as well as the amount and types of pigmentation and co-solvents used. In general, the moisture content should vary between 0 to 10 percent based on total resinous vehicle solids. If the coating has too high a moisture content, it is liable to have low "green strength" (uncured) and actually tear apart and stick to the transfer rolls while passing to the coating station. If the moisture content of the coating is too high, it may cause blistering of the top coat during baking. The problem of the coating sticking to the transfer rolls cannot be over-emphasized. In most coil electrocoating operations, the electrodeposition tank is located a significant distance away from the topcoating station. The coated metal coil strip may have to pass over numerous transfer and change of direction rolls in getting to the coating station.

Although not shown in the drawings, it should be appreciated that the electrodeposition bath should be replenished with resinous vehicle to compensate for that which is removed from the bath as primer coating. Replenishing the bath in a continuous manner with vehicle is well known in the art and further explanation at this point is not considered necessary.

After the coated sheet has been removed from the bath, passed through squeegee rolls and air dried to remove dragout and surface moisture, the sheet is topcoated according to methods well known in the art. For example, the coated sheet is led by guide rolls 13 to a roll coater 14 where the top coat is applied. Besides a roll coater, a spray coater could also be used. It should be mentioned that the top coat is applied without having previously baked the primer coating. Although the primer coating can be air dried, this is not the equivalent of baking in which the metal substrate reaches temperatures sufficient to coalesce the primer coating and to crosslink it if a thermosetting primer is used.

The top coat may be any aqueous or solvent-based coating composition well known in the art for application to coil. The coating can be a thermoplastic or a thermosetting composition and among the top coats which can be used are acrylics, polyesters, alkyds, epoxy and fluoropolymers. Preferred topcoating compositions are thermosetting acrylic coating compositions such as described in U.S. Pat. No. 3,079,434 to Christenson et al.

The thickness of the top coat will vary depending upon the application desired. For most coil applications, top coat thickness of 0.2 to 3 mils, preferably 0.5 to 1 mil are typical.

After topcoating, the coated metal sheet is passed to a baking oven 15 where both the primer and the top coat are simultaneously baked to cure the coatings. Temperature of baking should be sufficient to cause coalescence of the top coat to form a continuous film of uniform thickness. The cured coating should be hard to the touch. If the top coat is thermosetting in nature, the temperature should be sufficient to crosslink the top coat. Usually, bake temperatures (measured as peak metal temperature) of about 200° to 250° C. are used. It should be appreciated that other means of crosslinking can be used, for example, infrared radiation, ultraviolet light and electron beam radiation.

After baking, the coated metal substrate is usually cooled either at ambient conditions or by passing the sheet through a chiller 17. When the coated sheet has cooled sufficiently, such that it is no longer tacky, it is passed to a point of accumulation such as a spool 19 where it is recoiled.

The resinous vehicle used in the method of the invention is a mixture of a water-soluble resinous material and a water-insoluble resinous material. The mixture is dispersed in an aqueous medium of which water is the principal ingradient.

The water-soluble resinous materials are polymeric and are made water-soluble by the incorporation of sufficient hydrophilic groups into the polymer. The hydrophilic groups can be ionic salt groups, for example, anionic salt groups such as carboxylic and sulfonic acid salt groups, or cationic salt groups such as amine salt groups and quaternary ammonium salt groups. The preferred hydrophilic groups are anionic groups, most preferably salts of carboxylic acid groups. Usually a polymer is prepared with carboxylic acid groups and then neutralized with a water-soluble basic compound such as an organic amine or an alkali metal hydroxide.

The term "water-soluble" in the context of the present invention means that the resinous material can be solubilized or dispersed in water at a resin solids content of up to 25 percent, usually 1 to 20 percent by weight, without the aid of externally added surfactant. The solutions or dispersions appear optically clear or translucent with the resin being the dispersed phase and having an average particle size of 0.12 and less and usually less than 0.09 micron. The average particle size of the water-soluble resinous materials can be determined by light scattering techniques. The average particle size is determined by measuring the turbidity of the dispersion and applying the Mie theory to this measurement. See article entitled "Measurement of Particle Size of Anionic Electrodeposition Resin Micelles and Factors which Influence Micelle Size" by P. E. Pierce and C. E. Cowan appearing in *Journal of Paint Technology*, Vol. 44, No. 568, May 1972, for experimental technique for measuring average particle size.

The molecular weight of the water-soluble polymer can vary depending on the type of polymer used and the percentage of hydrophilic groups in the polymer. Usually the molecular weight will vary from as low as 400 to as high as 30,000 on a number average basis. Molecular. weights much below 400 are undesirable because the polymers tend to remain soluble and not electrodeposit, whereas molecular weights much above 30,000 result in very high polymer viscosities which are difficult to handle.

The glass transition temperature ($T_g$) of the low molecular weight polymer preferably should be controlled so as to achieve the proper flow on electrodeposition and the required non-tacky coating. The $T_g$ of the low molecular polymer should be less than the operating temperature of the bath. Low molecular weight polymers with $T_g$'s much higher than the operating temperature of the bath are undesirable because they do not flow well upon electrodeposition and result in powdery friable coatings. Low molecular weight polymers with $T_g$'s much lower than the operating temperature of the bath are not desired because they generally result in tacky coatings. The $T_g$, although important, is not critical since the tackiness and friability of the coating can be compensated for in formulating the electrodeposition bath. For example, pigments can be used to harden the coating, and various co-solvents used to improve the coalescence of the coating.

The glass transition temperature of the polymer is the temperature at which the polymer changes from a hard, more or less brittle glass-like material to a leathery or viscous polymer. When heating to the glass transition temperature, there is an abrupt increase in the coefficient of expansion, compressibility and specific heat. The glass transition temperature ($T_g$) is taken as the midpoint of the temperature interval over which the discontinuity takes place. Glass transition values may be determined according to methods well known in the art such as by a penetrometer or by differential thermal analysis.

The preferred low molecular weight water-soluble polymers are acrylic interpolymers containing an anionic charge, preferably a carboxylate salt group, and most preferably an organic amine neutralized carboxylic acid group.

Among the low molecular weight acrylic interpolymers which may be used are those polymers formed by interpolymerizing an alpha, beta-ethylenically unsaturated carboxylic acid with a methacrylic acid ester and/or acrylic acid ester. In general, acrylic polymers are useful that have the major portion of a methacrylate ester of a $C_1$ to $C_8$ alcohol and a minor portion of an acrylate ester of $C_1$ to $C_8$ alcohol. Following are typically useful methacrylate esters and acrylate esters: ethyl acrylate, propyl acrylate, isopropyl acrylate, butyl acrylate, isobutyl acrylate, secondary butyl acrylate, hexyl acrylate, 2-ethylhexyl acrylate, octyl acrylate; methyl methacrylate, propyl methacrylate, isobutyl methacrylate, butyl methacrylate, secondary butyl methacrylate and tertiary butyl methacrylate.

The acrylic polymers used in this invention contain 0.1 to 20 percent by weight of a polymerized alpha, beta-ethylenically unsaturated carboxylic acid unit. Typically useful alpha, beta-ethylenically unsaturated carboxylic acid monomers are methacrylic acid, acrylic acid, itaconic acid, ethacrylic acid, propyl acrylic acid, isopropyl acrylic acid and homologs of these acids. Methacrylic acid and acrylic acid are preferred since these acids form particularly high quality polymers. The precentage of acid is adjusted to give the required acid number in the acrylic polymer. Usually the acid number of the acrylic polymer should be adjusted so that it is about 30 to 100 on resin solids. The number average molecular weights of the water-soluble acrylic polymers preferably range from 10,000 to 30,000.

The acrylic polymers used in this invention may also contain pendant hydroxyl groups which are attained by copolymerizing hydroxyalkyl acrylates or hydroxyalkyl methacrylates with the aforementioned acrylic esters. The pendant hydroxyl groups provide sites for subsequent curing such as with an aminoplast or blocked isocyanate. Preferably, 5–15 percent by weight of the acrylic polymer used in this invention is of a hydroxyalkyl acrylate or methacrylate ester. Typically useful hydroxyalkyl acrylates and methacrylates contain 1–8 carbon atoms in the alkyl group and are, for example, hydroxyethyl acrylate, hydroxypropyl acrylate, hydroxybutyl acrylate, hydroxyethyl methacrylte, hydroxypropyl methacrylate, hydroxybutyl methacrylate, hydroxyhexyl methacrylate and hydroxyoctyl methacrylate.

Other vinyl copolymerizable compounds can be used to form part of the acrylic polymers useful in this invention, such as styrene, vinyl toluene, acrylamide, vinyl xylene, allyl alcohol and acrylonitrile.

In one particularly useful acrylic polymer, the acrylic polymer consists essentially of: a hard constituent which is either styrene or a lower alkyl methacrylate where the alkyl group has 1 to 2 carbon atoms or a mixture of styrene and the lower alkyl methacrylate such as ethyl acrylate; a soft constituent which is either a lower alkyl methacrylate containing 3 to 8 carbon atoms in the alkyl group or lower alkyl acrylate containing 2 to 8 carbon atoms in the alkyl group; a hydroxy lower alkyl methacrylate or acrylate having 1 to 4 carbon atoms in the alkyl group and an alpha, beta-ethylenically unsaturated carboxylic acid as described above.

Besides water-soluble acrylic resins, polyesters which are formed from saturated or aromatic polycarboxylic acid and a polyol are useful low molecular weight film-forming polymers. Typical saturated aliphatic dicarboxylic acids are anhydrides useful in forming these polyesters have from 2 to 10 carbon atoms such as succinic acid, azelaic acid and adipic acid. Examples of aromatic dibasic acids or their anhydrides are phthalic acid and trimellitic acid. The amount of acid for the polyester is adjusted to achieve the desired acid value which for the polyester should be from about 20 to 85. Many polyols can be reacted with the aforementioned acids to form the desired polyesters. Particularly useful diols are, for example, ethylene glycol, 1,4-butanediol, neopentyl glycol, sorbitol, pentaerythritol and trimethylolpropane.

Somewhat related to the polyesters are the alkyd resins which are polymeric esters prepared from the condensation product of a polyhydric alcohol such as glycerol and ethylene glycol, and a drying oil fatty acid such as linseed oil and tall oil are also useful as the water-soluble film-forming polymers. Another acid constituent is usually added to provide the alkyd resin with the desired acid number. For example, alpha, beta-ethylenically unsaturated dicarboxylic acid or the anhydride of the acids can be used, such as maleic acid or maleic anhydride.

Preferably these alkyd resins have a number average molecular weight of 1000–2500 and acid number of 20 to 85.

Another film-forming low molecular weight carboxylic polymer used to form the electrocoating compositions of the invention is a polymer of styrene and a 3–10 carbon atom ethylenically unsaturated alcohol, such as allyl alcohol. The polymer can be further reacted with a drying oil fatty acid and with an acid constituent such as those mentioned above to provide the required acid number, usually within the range of 20 to 80. The number average molecular weights of the styrene allyl alcohol copolymers are usually within the range of 1000 to 10,000.

Epoxy esters are also useful low molecular weight water-soluble vehicles. These materials are obtained by partially esterifying an epoxy resin with a conventional drying oil fatty acid such as those mentioned above and then fully esterfying this resin with an alpha, beta-ethylenically unsaturated dicarboxylic acid or anhydride such as those mentioned above. The epoxy resin itself is preferably a polyglycidyl ether of a bisphenol such as Bisphenol A.

Examples of other suitable low molecular weight resinous vehicles are the neutralized reaction products of an unsaturated carboxylic acid such as maleic acid or anhydride and a drying oil such as linseed oil.

In preparing the adduct of the carboxylic acid or anhydride and the drying oil, about 14 percent to 45 percent by weight of the unsaturated acid or anhydride should be reacted with about 55 to 86 percent by weight of the drying oil. The acid number of such products usually ranges from about 50 to 200.

Besides the adducts of unsaturated dicarboxylic acids or anhydrides and drying oil, adducts of unsaturated dicarboxylic acids or anhydrides such as maleic acid or its anhydride and polybutadiene can also be employed. Polybutadienes which are useful are described in U.S. Pat. No. 3,789,046 to Heidel. By the term "polybutadiene" is meant a homopolymer of conjugated diolefin containing from 4 to 6 carbon atoms such as 1,3-butadiene, isoprene, piperylene or mixtures thereof. Homopolymers and copolymers of 1,3-butadiene (butadiene) are preferred. Especially preferred polybutadienes are liquid polybutadiene homopolymers described in DAS-1,186,631. Usually the adduct contains from about 5 to 25 percent by weight unsaturated acid and the remainder polybutadiene.

Besides the low molecular weight polymeric materials which are solubilized with anionic groups, low molecular weight polymeric materials which are solubilized with cationic groups can also be used. Examples of suitable low molecular weight polymers would be the acrylic interpolymers mentioned above in which part of the monomer charge contains a tertiary amine-containing acrylate or methacrylate such as dimethylaminoethyl methacrylate, diethylaminoethyl acrylate and diethylamino acrylate and the like. These polymers can be dissolved or dispersed in water with the addition of a water-dispersible acid such as acetic acid or can be quaternized with an alkylating agent such as methyl iodide or dimethyl sulfate to form the required cationic charge. In addition to the tertiary amine-containing acrylates and methacrylates, monomers such as methyl vinyl pyridine and the like can also be used.

Another example of low molecular weight water-soluble polymeric materials containing an anionic charge is the reaction product of polyepoxides such as the polyglycidyl ethers of polyphenols mentioned above reacted with a secondary amine such as dimethylamine or diethylamine. These adducts can then be neutralized with acid or can be quaternized as described above to form the required cationic groups. With regard to the acid solubilized amine-polyepoxide adducts, reference is made to U.S. Pat. No. 3,984,299 to Jerabek for further details.

Besides the low molecular weight salt group stabilized water-soluble polymers mentioned above, the resinous vehicles of the invention also contain a water-insoluble resinous material. These materials are polymeric and prepared from essentially hydrophobic, polymerizable reactants, such as ethylenically unsaturated monomer compositions containing one or more polymerizable ethylenically unsaturated compounds which when copolymerized with each other form water-insoluble polymers. The polymerizable ethylenically unsaturated compounds are represented by non-ionic monomers such as the alkenyl aromatic compounds, that is, the sytrene compounds, the derivatives of alpha-methylene monocarboxylic acids such as acrylic esters, acrylic nitriles and methacrylic esters; derivatives of alpha, beta-ethylenically unsaturated dicarboxylic acids such as maleic esters; unsaturated alcohol esters; conjugated dienes; unsaturated ketones, unsaturated ethers; and other polymerizable vinylidene compounds such as vinyl chloride and vinylidene fluoride. Specific examples of such ethylenically unsaturated compounds are styrene, alpha-methyl styrene, alpha-ethyl styrene, dimethyl styrene, diethyl styrene, t-butyl styrene, vinyl naphthalene, hydroxy styrene, methoxy styrene, cyano styrene, acetyl styrene, monochlorostyrene, dichlorostyrene, and other halostyrenes, methyl methacrylate, ethyl acrylate, butyl acrylate, hexyl acrylate, 2-ethylhexyl acrylate, lauryl methacrylate, phenyl acrylate, 2-hydroxybutyl acrylate, 2-hydroxybutyl methacrylate, 4-hydroxybutyl acrylate, and 4-hydroxybutyl methacrylate; acrylonitrile, methacrylonitrile, acryloanilide, ethyl alpha-chloroacrylate, ethyl maleate, vinyl acetate, vinyl propionate, vinyl chloride, vinyl bromide, vinylidene chloride, vinylidene fluoride, vinyl methyl ketone, methyl isopropenyl ketone, vinyl ethyl ether, 1,3-butadiene and isoprene.

The non-ionic monomers mentioned above form water-insoluble homopolymers or water-insoluble copolymers when more than one of the group is used. However, there may be used as copolymerized constituents for the above kind of monomers other non-ionic monomers which as homopolymers would be water soluble. The hydrophilic, water-soluble non-ionic monomers are represented by hydroxyethyl acrylate, hydroxyethyl methacrylate, acrylamide, methacrylamide, n-methylol acrylamide, n-methylol methacrylamide, and other modified acrylamides such as diacetone acrylamide and diacetone methacrylamide. Such monomers are not used in sufficiently large portions as to make the copolymer water soluble. The proportions of such somewhat hydrophilic water-soluble, non-ionic monomers ordinarily range from 0 to about 30 percent or more based on total weight of the copolymer.

In the specification, by the term "essentially hydrophobic, polymerizable, ethylenically unsaturated monomer composition" is meant a monomer or mixture of monomers according to the foregoing description.

The water-insoluble polymers of the invention are conveniently prepared from the above-described monomers by conventional emulsion polymerization using free radical producing catalyst, usually in an amount of about 0.01 percent to about 3 percent based on weight of the monomers. Examples of suitable catalyst include water-soluble salts such as ammonium persulfate and oil-soluble catalyst such as 2,2'-azobisisobutyronitrile. The emulsion polymerization can be conducted in a batchwise, incremental or continuous type addition of the monomers, water and other constituents to a reaction vessel or to a series of such vessels or by polymerization in a coil reactor. Conventional additives for latex compositions may be included in small but usual amounts in a known manner. Such materials include, but are not limited to, chain transfer agents, short stopping agents, buffers, anti-foaming agents, and the like.

By the term "water-insoluble" is meant the resinous material to be dispersed in water is emulsified in water with the aid of externally added surfactant at a solids content of 5 to 25 percent. The emulsions appear opaque with the resin being the dispersed phase and have an average particle size of greater than 0.2 micron and usually within the range of 0.5 to 2 microns; the average particle size being determined according to light scattering techniques discussed above in connection with the average particle sizes of the water-soluble resinous materials. The water-insoluble emulsions are commonly referred to as latices or emulsions.

Non-ionic or ionic surfactants are usually employed to stabilize the latex. When the water-soluble resinous material is stabilized by anionic salt groups, the surfactant used to stabilize the water-insoluble resinous material should also be anionic or non-ionic. On the other hand, when the water-soluble resinous material contains cationic salt groups, the surfactant used to stabilize the water-insoluble resinous material should be cationic or non-ionic.

Examples of anionic emulsifiers that may be used include ordinary soaps such as the alkali metal, ammonium and alkanol amine salts of fatty acids such as sodium oleate, ammonium stearate and ethanolamine laurate. Also, synthetic saponaceous materials including the higher aliphatic sulfates and sulfonates such as sodium lauryl sulfate may be employed. Examples of other anionic emulsifiers which may be used include sodium alkyl aryl sulfonates such as sodium isopropyl benzene sulfonate and the alkali metal salts of sulfonated dicarboxylic acid esters and amides such as sodium dioctyl sulfo-succinate, sodium N-octadecyl-sulfonsuccinamide. Mixtures of anionic emulsifiers may be used as well as mixtures of anionic and non-ionic emulsifiers.

Suitable non-ionic emulsifiers include alkylphenoxypolyethoxyethanols having alkyl groups of about 7 to 18 carbon atoms and 6 to 60 or more oxyethylene units, such as heptylphenoxypolyethoxyethanols, octaphenoxypolyethoxyethanols, nonylphenoxypolyethoxyethanols and dodecylphenoxypolyethoxyethanols; ethylene oxide derivatives of long chain dicarboxylic acids such as lauric, myristic, palmitic, oleic; and analogous ethylene oxide condensates of long chain alcohols, such as octyl, decyl, lauryl or acetyl alcohols, ethylene oxide derivatives of etherified or esterified polyhydroxy compounds having a hydrophobic hydrocarbon chain, such as sorbitan monostearate containing 6 to 60 oxyethylene units; condensates of long chain or branched chain amine such as dodecyl amine, hexadecyl amine and octadecyl amine, containing 6 to 60 oxyethylene groups; blocked copolymers of ethylene oxide and propylene oxide comprising a hydrophobic polypropylene oxide section combined with one or more hydrophilic ethylene oxide sections. Also, mixtures of non-ionic emulsifiers may be used.

Suitable cationic emulsifiers include:

quaternary ammonium salts, for example, tetramethyl ammonium chloride and diisopropyl dimethyl ammonium chloride; and alkylene oxide condensates of an organic amine where a typical structure is:

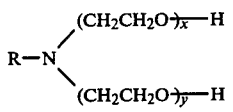

where R is a fatty alkyl group preferably having about 12 to 18 carbon atoms and x and y represent whole numbers of from 1 to about 20, typical products of this type being ethylene oxide condensation products of cocoamines, soybean amines and the like, having an average molecular weight of 200 to 3000.

The amount of emulsifier or mixture of emulsifiers required varies primarily with the concentration of the monomers in the aqueous medium and to an extent with the choice of emulsifier, monomers and proportions of monomer. Generally, the amount of emulsifying agent is between 0.5 and 12 percent based on weight of mixture of monomers and preferably from about 0.5 to 4 percent of this weight; the percentage by weight being based on total monomer weight.

The water-insoluble resinous materials are polymeric and their molecular weights are usually at least 250,000, usually within the range of 750,000 to 2 million on a weight average basis as measured by gel permeation chromatography.

Examples of suitable water-insoluble polymers other than those mentioned above are styrene-butadiene latices, vinyl chloride and vinylidene chloride homopolymers and copolymer latices and fluorocarbon polymer latices.

As with the water-soluble polymers, the $T_g$ of the water-insoluble polymers should preferably be controlled so as to achieve proper flow on electrodeposition and the required non-tacky coating. The considerations governing the selection of $T_g$ for the water-soluble polymers also govern the selection of $T_g$ for the water-insoluble polymers.

The water-soluble and water-insoluble polymers must be compatible with one another in the electrodeposition bath. By compatible is meant that they both remain dispersed during the electrocoating process and do not agglomerate or precipitate. Further, polymers in combination must electrodeposit on the workpiece and coalesce to form a film.

The ratio of water-insoluble resinous material to water-soluble resinous material useful in the practice of the invention will vary depending on choice of polymers and the type of coating desired and the compatibility of the polymers with one another. In general, on a resin solids basis from about 10 to 90, preferably 25 to 70 percent by weight water-soluble resin can be used with the remainder being water-insoluble resin. The most preferred resinous vehicles use about 50 percent by weight of each resin.

As mentioned, the resinous vehicle of the invention is dispersed in aqueous medium for use in electrodeposition. Water is the principal ingredient of the aqueous medium, constituting at least 60 percent of the aqueous medium. Besides water, the aqueous medium may contain a co-solvent. usually a coalescing solvent such as an alcohol, ester or ketone. The preferred coalescing solvents include alcohols, such as 2-ethylhexanol, monoalkyl ethers of glycols such as the monobutyl ether of ethylene glycol, or co-solvents are usually used in amounts less than 40 percent by weight of the aqueous medium.

The concentration of the resinous vehicle in the aqueous medium is not particularly critical. Resin solids contents of about 5 to 15 percent are recommended for the best appearing coating.

The primer coating can be applied as a clear coating, that is, without pigment or, if desired, a pigment can be included in the comparison. The pigment compositions may be of any conventional type, for example, iron oxides, lead oxides, strontium chromate, carbon black, coal dust, titanium dioxide, talc and barium sulfate. The pigment content is usually expressed as pigment-to-resin ratio. Pigment-to-resin ratios within the range of 0.01 to 5.0:1 are usually used.

In one embodiment of the invention, a polyamine which contains at least 10 carbon atoms is included in the anionic electrodeposition bath. Preferably, the amine is a fatty diamine which contains at least 15 carbon atoms. Preferred amines are those obtained by reacting a primary amine with acrylonitrile to give the corresponding cyanoethylamine which upon hydrogenation gives a fatty diamine containing both primary and secondary amine groups. These products are commercially available from Armour Industrial Chemical Company under the trademark DUOMEEN. Examples of suitable primary amines are coco-amine, n-hexadecylamine, n-octadecylamine, hydrogenated tallow amine and tallow amine. A preferred polyamine is N-coco-1,3-diaminopropane which is commercially available under the trademark DUOMEEN CD.

Illustrating the invention are the following working examples, which are not to be construed as limiting the invention to their details.

In the following examples, various water-solubilized resinous coating materials were blended with various water-insoluble emulsified resinous materials to form electrodeposition vehicles. The vehicles were ultrafiltered to remove resin fragments and impurities and reconstituted with deionized water and readjusted with dimethylethanolamine to form about 8 percent solids electrodeposition baths, at 105 percent total neutralization equivalents.

Trivalent chromium pretreated aluminum panels were electrocoated in the various baths under conditions which closely approximated the continuous electrodeposition of pretreated coil aluminum sheet stock. The panels which were charged either for anionic or cationic electrodeposition were passed vertically into the electrodeposition bath at a speed of 120 feet a minute adjacent to an oppositely charged electrode. A voltage was impressed between the electrodes and maintained for about five seconds after which time the panels were removed vertically from the bath and the excess electrodeposition vehicle removed from the panel with a rubber wiper blade. The panels were then topcoated by drawing down with a drawbar with either a solvent-base (DURACRON SUPER 650 commercially available from PPG Industries, Inc.) or a water-base (ENVIRON commercially available from PPG Industries, Inc.) white acrylic paint and baked to cure the coatings. With the DURACRON SUPER 650 paint, a 0.036 inch (0.091 cm) wire wound drawbar was used and the coatings were baked in a 500° F. (260° C.) gas fired oven to a peak metal temperature of 465° F. (241° C.) attained in 65 seconds. In the case of the ENVIRON paint, a 0.028 inch (0.071 cm) wire wound drawbar was used and the coatings were baked in a 500° F. (260° C.) gas fired oven to a peak metal temperature of 420° F. (216° C.) attained in 45 seconds.

Unless otherwise indicated, the electrodeposition baths of the following examples were passed through an ultrafilter before being used for electrodeposition. This removed low molecular weight resinous fragments and low molecular weight impurities present in the baths.

EXAMPLE I

A water-soluble acrylic resin having a solids content of about 73 to 76 percent, an acid number of 95–115 (based on resin solids) and sold commercially by American Cyanamid Company for use in anionic electrodeposition as XC-4010 was combined with melamine-type curing agent and solubilized in deionized water to form an 8 percent solids dispersion in the following charge ratio:

| Ingredient | Parts by Weight |
|---|---|
| XC-4010 | 307.2 |
| XM-1116[1] | 57.6 |
| dimethylethanolamine[2] | 35.6 |
| deionized water | 3199.6 |

[1]Mixed methyl, ethyl ether of hexamethylol melamine.
[2]105 percent total theoretical neutralization.

An emulsified acrylic latex commercially available from Rohm and Haas Company as E-717 was further diluted with deionized water to form an 8 percent solids latex.

| Ingredient | Parts by Weight |
|---|---|
| E-717 | 635.8 |
| deionized water | 2964.2 |

Eighteen hundred (1800) parts by weight of the water-solubilized acrylic was blended with 1800 parts by weight of the diluted acrylic latex to form an electrodeposition bath.

Pretreated aluminum panels were anionically electrodeposited in this bath at 260 volts for 5 seconds (amperage drop of 14 to 1.3) at a bath temperature of 70° F. (21° C.) to give continuous primer coatings having a thickness of about 0.20 mil and good wet adhesion to the substrate.

The coated substrates prepared as described above were topcoated with either a solvent-base or aqueous-base white acrylic paint and baked as described above. The top coat at the completion of baking looked very good with no blistering, pinholing or any other imperfection. The 60° gloss of the solvent-based top coat after baking was 10.8 as compared to a control sample with no previous primer coating of 8.5. This slight increase in gloss indicated minimal chemical interaction between the primer and the top coat.

It was found that higher bath temperatures, that is, about 90 to 110° C., provided for even better wet adhesion of the primer to the substrate.

In the electrodeposition bath used above, the percentages by weight of solubilized acrylic and the emulsified acrylic latex were 50/50. Electrodeposition baths containing 35/65 and 25/75 weight ratios of solubilized to emulsified acrylic also coated out well.

It was also found that the solubilized acrylic and the emulsified acrylic did not electrodeposit as effectively by themselves as they did in combination. For example, pretreated aluminum panels which were electrodeposited with solubilized acrylic at 100 volts for 5 seconds at a bath temperature of 80° F. (27° C.) (amperage drop of 9.0 to 5.0) produced very sticky, wet films of about 0.17 mil thickness. When topcoated with the DURACRON SUPER 650 paint and baked as described above, the top coat evidences draw marks and had a 60° gloss of 20. The ENVIRON topcoated sample evidences severe "crawling" after baking.

The high molecular weight latex was not suitable for use in electrodeposition by itself.

EXAMPLE II

A water-soluble alkyd resin sold by Amoco Chemical Company for use in anionic electrodeposition as Amoco 3823EC TMA polyester was combined with the XM-1116 curing agent and solubilized in deionized water to form an 8 percent solids dispersion in the following charge ratio:

| Ingredient | Parts by Weight |
|---|---|
| alkyd resin[1] | 264.8 |
| XM-1116 | 57.6 |
| dimethylethanolamine[2] | 14.7 |
| deionized water | 3262.9 |

[1]The alkyd resin was described by the manufacturer as having an acid number of 38–42 and being prepared from the following reactive ingredients:

| Ingredient | Mole Ratio |
|---|---|
| safflower oil | 2.2 |
| hydrogenated Bisphenol A | 6 |
| isophthalic acid | 2 |
| trimellitic anhydride | 3 |

[2]105 percent total theoretical neutralization.

Eighteen hundred (1800) parts by weight of the water-solubilized alkyd was combined with 1800 parts by weight of the diluted acrylic latex described in Example I (E-717) to form 8 percent solids electrodeposition baths.

Pretreated aluminum panels were anionically electrodeposited in this bath at 50 volts for 5 seconds at a bath temperature of 70° F. (21° C.), amperage drop of 2.2 to 0.9, to give continuous primer coatings having good wet adhesion to the substrate.

The coated substrates were then topcoated with either a solvent-base or aqueous-base white acrylic paint and baked as described above. The top coats at the completion of baking looked very good with no pinholing or blistering. The 60° gloss of the solvent-based top coat after baking 13.2 as compared to the control of 8.5 which indicated slight but acceptable interaction between the top coat and the primer.

It was found that higher bath temperatures, that is, about 90 to 110° C., provided even better wet adhesion of the primer to the substrate.

It was also found that the solubilized polyester did not electrodeposit as effectively by itself as it did in combination with the acrylic latex. For example, when a pretreated aluminum panel was electrodeposited with the solubilized polyester at 75 volts for 5 seconds at a bath temperature of 70° F. (21° C.) (amperage drop of 3.0 to 2.0), a very sticky film of about 0.32 mil thickness was obtained. When topcoated with the DURACRON SUPER 650 paint and baked as described above, the top coat had considerable pinholes. The ENVIRON topcoated sample evidenced severe "crawling" after baking.

EXAMPLE A

A maleinized tall oil fatty acid adduct was prepared from the following charge:

| Ingredient | Parts by Weight |
|---|---|
| tall oil fatty acid | 4542 |
| maleic anhydride | 1566 |
| xylol | 180 |

The ingredients were charged to a reaction vessel and heated to reflux under a nitrogen blanket. The reaction mixture was refluxed for 5 hours at 470° F. (243° C.). The xylol was then distilled by heating the reaction mixture to 500° F. (260° C.) and sparging nitrogen through the reaction mixture. The xylol-stripped resinous reaction product had a solids content of 100 percent, a Gardner-Holdt viscosity of Z-$Z_2$, and an acid number of about 255.

EXAMPLE B

A water-soluble epoxy ester for use in anionic electrodeposition was prepared from the following charge:

| Ingredient | Parts by Weight |
|---|---|
| EPON 829[1] | 110.6 |
| Bisphenol A | 45.8 |
| xylol | 3.0 |
| sodium carbonate | 0.07 |
| tall oil fatty acid | 86.8 |
| maleinized tall oil of Example A | 99.0 |
| CELLOSOLVE[2] | 77.5 |
| butanol | 67.9 |
| deionized water | 7.3 |
| diethylethanolamine | 28.0 |

[1]Condensation product of epichlorohydrin and Bisphenol A having an epoxy equivalent of 193-203 and a molecular weight of 386-406, commercially available from Shell Chemical Company.
[2]Ethylene glycol monoethyl ether.

The EPON 829, Bisphenol A and xylol were charged to a reaction vessel under a nitrogen blanket and heated to 280° F. (138° C.) to initiate an exotherm. The exotherm was maintained for 30 minutes with the highest temperature reaching 350° F. (177° C.). The sodium carbonate was then added to the reaction mixture and the mixture agitated for 5 minutes followed by the addition of the tall oil fatty acid. The reaction mixture was heated to 480° F. (249° C.) until the reaction mixture had an acid value of 5 or less. The reaction mixture was then cooled to 270°-280° F. (132°-138° C.) and the maleinized tall oil added. The temperature of the reaction mixture was held at 260°-270° F. (127°-132° C.) for about 2 hours followed by the addition of the CELLOSOLVE, first portion of butanol and deionized water. The reaction mixture was then cooled to 120° F. (49° C.) and the diethylethanolamine and the second portion of butanol added. The reaction mixture had a solids content of 65 percent.

EXAMPLE III

The maleinized epoxy ester prepared as described above in Example B was neutralized with dimethylethanolamine (105 percent total theoretical neutralization), combined with a melamine-formaldehyde condensate and dispersed in water to form an 8 percent solids dispersion in the following charge ratio:

| Ingredient | Parts by Weight |
|---|---|
| maleinized epoxy ester prepared as described in Example B | 355.0 |
| XM-1116 | 57.6 |
| dimethylethanolamine | 12.3 |
| deionized water | 3175.1 |

An emulsified styrene-butadiene latex having a solids content of 56 percent and commercially available from Goodyear Chemical Division as PLIOLITE 491 was further diluted with deionized water to form an 8 percent solids latex.

Eighteen hundred (1800) parts by weight of the dispersed maleinized epoxy ester was combined with 1800 parts by weight of the 8 percent solids styrene-butadiene latex to form an 8 percent solids electrodeposition bath.

Pretreated aluminum panels were anionically electrodeposited in this bath at 55 volts for 5 seconds at a bath temperature of 70° F. (21° C.) to give continuous primer coatings having excellent wet adhesion to the substrate.

The coated substrates were then topcoated with either a solvent-base or aqueous-base white acrylic paint and baked as described above. The top coats at the completion of baking looked very good with no pinholing, blistering or any other imperfection. The 60° gloss on the solvent-based top coat after baking was 12.0 as compared to a control of 8.5.

In the electrodeposition bath used in Example III, the percentage by weight of the solubilized epoxy ester to the styrene-butadiene latex was 50/50. Electrodeposition baths containing a weight ratio of 35/65 also coated out well.

It was found that the maleinized epoxy ester and the styrene-butadiene latex do not electrodeposit as effectively by themselves as they do in combination. For example, the maleinized epoxy ester electrodeposited at a variety of voltages to form a very sticky film. When topcoated with the DURACRON SUPER 650 paint and baked as described above, the top coat had considerable pinholes. The 60° gloss was 21.1. The ENVIRON topcoated sample evidenced some "crawling" and total microblistering.

The styrene-butadiene latex did not electrodeposit at any voltage.

EXAMPLE C

A water-soluble maleinized linseed fatty acid adduct for use in anionic electrodeposition was prepared from the following charge:

| Ingredient | Parts by Weight |
|---|---|
| linseed oil | 4800 |
| maleic anhydride | 1200 |
| xylol | 288 |
| diethylamine | 170 |

The linseed oil, maleic anhydride and xylol were charged to a reaction vessel under a nitrogen blanket and heated to 380° F. (193° C.) to initiate reflux. The reaction mixture was permitted to reflux for one hour with the highest temperature reaching 400° F. (204° C.). The temperature of the reaction mixture was raised to 500° F. (260° C.) while sparging the reaction mixture with nitrogen to distill the xylol. The reaction mixture was cooled to 120° F. (49° C.) and the diethylamine added followed by agitating the reaction mixture for one hour and then cooling to room temperature. The reaction mixture had a solids content of 100 percent.

EXAMPLE IV

The water-soluble linseed oil adduct was combined with dimethylethanolamine to further neutralize it to a 105 percent total theoretical neutralization and dispersed in deionized water to form an 8 percent solids dispersion in the following charge ratio:

| Ingredient | Parts by Weight |
|---|---|
| maleinized linseed oil adduct prepared as described in Example C | 295.2 |
| dimethylethanolamine | 39.4 |
| deionized water | 3265.4 |

Eighteen hundred (1800) parts by weight of the dispersed maleinized linseed oil adduct was combined with 1800 parts by weight of the 8 percent solids styrene-butadiene latex (PLIOLITE 491) of Example 3 to form an 8 percent solids electrodeposition bath.

Pretreated aluminum panels were anionically electrodeposited in this bath at 200 volts for 5 seconds at a bath temperature of 80° F. (27° C.) to give a continuous, slightly sticky film of 0.22 mil thickness having excellent wet adhesion to the substrate.

The coated substrates were then topcoated with either a solvent-base or an aqueous-base white acrylic paint and baked as described above. Excellent looking top coats were obtained with no blistering, pinholing or any other imperfection. The 60° gloss of the solvent-based top coat after baking was 12.5 as compared to a control with no primer of 8.5.

Use of the maleinized linseed oil fatty acid adduct by itself gave an electrodeposited coating which was judged too sticky for use as a primer.

EXAMPLE V

An emulsified polyvinylidene fluoride latex having a solids content of 55 percent commercially available from Pennwalt Corporation as KYNAR RC9106 was combined with dimethylethanolamine and deionized water to form an 8 percent solids latex.

| Ingredient | Parts by Weight |
|---|---|
| KYNAR latex (55 percent solids) | 514.3 |
| dimethylethanolamine | 2.6 |
| deionized water | 3085.7 |

Eighteen hundred (1800) parts by weight of the 8 percent solids polyvinylidene fluoride latex was combined with 1800 parts by weight of the solubilized low molecular weight acrylic prepared as described in Example I to form an 8 percent solids electrodeposition bath.

Pretreated aluminum panels were anionically electrodeposited in this bath at 150 volts for 5 seconds at a bath temperature of 90° F. (32° C.) to form a continuous film having a thickness of about 0.18 mil. The film was slightly sticky but had good wet adhesion to the substrate.

The coated substrates were then topcoated with either the solvent-based or aqueous-based white acrylic paints and baked as described above to cure the coatings. The solvent-based top coats at the completion of baking looked very good with no pinholing or any other imperfection. The 60° gloss of the solvent-based top coat after baking was 17.1 as compared to a control of 6.5. The water-based top coat after curing evidenced some crawling and blistering.

EXAMPLE D

A water-soluble acrylic polymer containing tertiary amine groups which are neutralizable to form cationic (amine salt) groups was prepared from the following charge:

| Ingredient | Parts by Weight |
|---|---|
| butyl CELLOSOLVE[1] | 782.1 |
| water | 79.1 |
| styrene | 839.6 |
| dimethylaminoethyl methacrylate | 419.6 |
| butyl acrylate | 419.6 |
| hydroxyethyl acrylate | 419.6 |
| tertiary dodecyl mercaptan | 20.1 |
| VAZO[2] | 24.5 |
| butyl CELLOSOLVE | 33.8 |
| tertiary butyl perbenzoate | 4.3 |

[1]Ethylene glycol monobutyl ether.
[2]Azobisisobutyronitrile.

The first portion of the butyl CELLOSOLVE and water were charged to a reaction vessel under a nitrogen blanket and heated to reflux at 110° C. A monomer charge comprising a mixture of the styrene, dimethylaminoethyl methacrylate, butyl acrylate, hydroxyethyl acrylate, tertiary dodecyl mercaptan and the VAZO was then charged to the reaction vessel over a 3-hour period to form a reaction mixture. During the addition, the temperature in the reaction vessel increased to 122° C. After the completion of the monomer addition, the tertiary butyl perbenzoate dissolved in the second portion of butyl CELLOSOLVE was added to the reaction mixture over a 2-hour period maintaining the temperature at about 120° C. The reaction mixture was held at 120° C. for an additional hour and then cooled to room temperature. The resin had a solids content of 68 percent.

EXAMPLE VI

The acrylic polymer prepared as described above in Example D was solubilized in deionized water with 85 percent lactic acid to form an 8 percent solids dispersion in the following charge ratio:

| Ingredient | Parts by Weight |
|---|---|
| acrylic polymer of Example D | 423.5 |
| 85 percent lactic acid | 24.8 |
| deionized water | 3160.2 |

An emulsified cationic acrylic latex commercially available from Rohm and Haas as E-1179 was further diluted with deionized water to form an 8 percent solids aqueous latex.

Eighteen hundred (1800) parts by weight of the diluted latex was combined with 1800 parts by weight of the dispersed low molecular weight cationic acrylic to form an 8 percent solids electrodeposition bath.

Pretreated aluminum panels were cationically electrodeposited in this bath at 50 volts for 5 seconds at a bath temperature of 70° F. (21° C.) to give a continuous film with only poor wet adhesion to the substrate. However, even with the poor wet adhesion, the primer coating accepted both the solvent and water-based top coats as described above. The coated substrates could be baked to give satisfactorily coated substrates.

EXAMPLE E

A water-soluble acrylic polymer containing anionic salt was prepared from the following charge:

| Ingredient | Parts by Weight |
|---|---|
| glacial acrylic acid | 144.0 |
| dimethylaminoethanol | 53.5 |
| ethyl CELLOSOLVE[1] | 423.9 |
| styrene | 432.0 |
| ethyl acrylate | 792.0 |
| N-(butoxymethyl) acrylamide solution[2] | 254.0 |
| deionized water | 1710.0 |
| VAZO[3] | 7.6 |
| tertiary-butyl perbenzoate | 6.9 |
| DUOMEEN CD[4] | 127.1 |

[1]Monoethyl ether of ethylene glycol.
[2]61.5 percent solid solution of N-(butoxymethyl) acrylamide in a mixed butanol/xylene solvent (3/1 weight ratio of butanol/xylene).
[3]Azobisisobutyronitrile.
[4]N-coco-1,3-aminopropane commercially available from Armour Industrial Chemical Company.

Four hundred nine (409) parts of the ethyl CELLOSOLVE were charged to a suitable reaction vessel under a nitrogen atmosphere and heated over a period of one hour to reflux at 235°-240° F. (113°-116° C.). During the heat-up, the styrene, ethyl acrylate, N-(butoxymethyl) acrylamide solution and acrylic acid were premixed and the mixture along with the VAZO were slowly added to the ethyl CELLOSOLVE with stirring. After reflux was initiated, the monomer addition and VAZO addition were continued for about 3 hours until the reaction mixture, as a 50 percent solids in ethyl CELLOSOLVE, had a Gardner-Holdt viscosity of K−. At that point, 2.3 parts of the tertiary-butyl perbenzoate dissolved in 10.3 parts of the ethyl CELLOSOLVE were added to the reaction mixture and the reaction mixture held at a temperature of 240°-250° F. (116°-121° C.) for about 2 hours until the reaction mixture, as a 50 percent solids solution in ethyl CELLOSOLVE, had a Gardner-Holdt viscosity of Z. At that point, 2.3 parts of the tertiary-butyl perbenzoate dissolved in 2.3 parts of the ethyl CELLOSOLVE were added to the reaction mixture and the reaction mixture held for 2 hours at 240°-250° F. (116°-121° C.) until the reaction mixture, as a 50 percent solids in ethyl CELLOSOLVE, had a Gardner-Holdt viscosity of Y. At that point, another 2.3 parts of tertiary-butyl perbenzoate dissolved in 2.3 parts of ethyl CELLOSOLVE were added to the reaction mixture and the mixture held for an additional 2 hours at 240°-250° F. (116°-121° C.) until the reaction mixture, as a 50 percent solids solution in ethyl CELLOSOLVE, had a Gardner-Holdt viscosity of V. At that point, the dimethylethanolamine preheated to 230°-235° F. (110°-113° C.) was charged to and below the surface of the reaction mixture, and the reaction mixture held at 210°-230° F. (99°-110° C.) for 40 minutes. The DUOMEEN CD was then added to the reaction mixture and the reaction mixture held at a temperature of 210°-220° F. (99°-104° C.) for 30 minutes. The reaction mixture was then thinned with 1560 parts of deionized water which was preheated to 163°-175° F. (73°-79° C.). The reaction mixture was held at 160°-165° F. (71°-74° C.) for one hour, cooled to 100° F. (38° C.) and thinned with an additional 150 parts of deionized water. The aqueous dispersion had a solids content of 40.4 percent, a Brookfield viscosity of 12,000 centipoises (No. 4 spindle at 20 revolutions per minute) and a pH of 7.9.

EXAMPLE VII

An electrodeposition bath was prepared from the following charge:

| Ingredient | Parts by Weight |
|---|---|
| aqueous acrylic dispersion prepared as described in Example E | 131.0 |
| mixed aqueous acrylic dispersion and latex[1] | 578.2 |
| dimethylethanolamine | 8.4 |
| deionized water | 2882.4 |

[1]42.65 percent solids mixture containing 55 percent by weight (based on solids) of E-717 latex and 45 percent by weight (based on solids) of acrylic dispersion of Example E.

The electrodeposition bath contained 8 percent total solids and 105 percent total theoretical neutralization equivalent.

Pretreated aluminum panels were anionically electrodeposited in this bath at 120 volts for 5 seconds at 110° F. (43° C.) to give continuous primer coatings having good wet adhesion to the substrate. The primer-coated substrates were topcoated with the water-base and solvent-base top coats as described in the earlier examples and baked as described in the earlier examples. The coatings at the completion of the baking were good looking, continuous, with no pinholing or blistering.

I claim:

1. A method for electrocoating a continuous length of flat metal sheet comprising:

(A) withdrawing the flat metal sheet from a source of supply and continuously (B) passing said sheet into an aqueous electrodeposition bath which contains as an electrocoating vehicle (1) a water-soluble resinous coating material, (2) a water-insoluble emulsified resinous material having a molecular weight of at least 250,000, (C) electrodepositing said vehicle on said sheet to form a primer coating as the sheet passes through the bath, (D) continuously removing the primer coated sheet from the bath and passing it to a coating station, (E) applying a top coat to the primer coated sheet at the coating station without having previously cured said primer, (F) curing the top and primer coatings simultaneously, and (G) leading the coated metal sheet to a point of accumulation.

2. The method of claim 1 in which the flat metal sheet is aluminum or steel sheet.

3. The method of claim 1 in which the water-soluble resinous coating material is an acrylic polymer containing an anionic charge.

4. The method of claim 1 in which the water-insoluble emulsified resinous material is an acrylic polymer containing an anionic surfactant.

5. The method of claim 1 in which the primer coating has a water content of less than 10 percent by weight measured shortly after removal of the electrocoated sheet from the electrodeposition bath and after removal of dragout from the surface of the coated sheet.

6. The method of claim 1 in which the top coat is a water-based or a solvent-based top coat.

7. The method of claim 6 in which the top coat is a thermosetting acrylic resin.

8. The method of claim 1 in which the curing step (F) is by baking.

9. A method for electrocoating a continuous length of flat metal sheet comprising:

(A) withdrawing the flat metal sheet from a source of supply and continuously (B) passing said sheet into an aqueous electrodeposition bath which contains as an electrocoating vehicle (1) a water-soluble resinous coating material, (2) a water-insoluble emulsified resinous material having a molecular weight of at least 250,000, (C) electrodepositing said vehicle on said sheet to form a primer coating as the sheet passes through the bath, (D) continuously removing the primer coated sheet from the bath and passing it to a coating station, (E) applying a top coat to the primer coated sheet at the coating station without having previously baked said primer, (F) baking the top and primer coatings simultaneously, and (G) leading the coated metal sheet to a point of accumulation.

* * * * *